US006907342B1

(12) United States Patent
Matsuoka

(10) Patent No.: US 6,907,342 B1
(45) Date of Patent: Jun. 14, 2005

(54) METHOD AND APPARATUS FOR DETECTING A CRANK ANGLE IN AN ENGINE

(75) Inventor: Yuji Matsuoka, Nagoya (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 08/897,933

(22) Filed: Jul. 21, 1997

(51) Int. Cl.[7] ..... F02D 41/00
(52) U.S. Cl. ..... 701/113; 73/117.3; 123/406.6
(58) Field of Search ..... 701/113, 110, 701/111; 73/116, 117.2, 117.3; 123/406.58, 406.63, 406.6

(56) References Cited

U.S. PATENT DOCUMENTS 5,197,325 A * 3/1993 Tamura et al. ..... 73/117.3
5,353,635 A 10/1994 Saiki et al. ..... 73/117.2
5,808,186 A * 9/1998 Matsumoto et al. ..... 73/117.3
6,041,647 A * 3/2000 Matsuoka ..... 73/116

FOREIGN PATENT DOCUMENTS

EP 0 128 817 A1 * 12/1984 ..... F02D/5/00
JP 6025410 A 2/1985

* cited by examiner

*Primary Examiner*—Hieu T. Vo
(74) *Attorney, Agent, or Firm*—Kenyon & Kenyon

(57) ABSTRACT

An apparatus for identifying a cylinder to be ignited in an engine. A plurality of teeth are formed on the periphery of the engine crankshaft. A sensor having two spaced detector parts senses the passage of the teeth. The detector parts identify the passage of a leading or a trailing edge of a tooth. An electronic control unit (ECU) determines the rotating direction of the crankshaft by comparing the signals from the two detector parts. Further, the ECU keeps a count indicating the position of the crankshaft and controls the engine in accordance with the count. The apparatus remembers the position of the crankshaft when the engine stops to improve re-ignition.

16 Claims, 10 Drawing Sheets

METHOD AND APPARATUS FOR DETECTING A CRANK ANGLE IN AN ENGINE

BACKGROUND OF THE INVENTION

1. Field of the Invention

The present invention relates to an apparatus for detecting the rotational angle of a crank (crank angle) of a crankshaft of an internal combustion engine. More specifically, the present invention pertains to an apparatus and method suitable for detecting the crank angle of a specific cylinder in a multi-cylinder internal combustion engine.

2. Description of the Related Art

Various timing controls related to the piston stroke of the engine, such as ignition timing control and fuel injection timing control, are executed in accordance with the crank angle of the engine, which is detected by a crank angle detection apparatus.

In an engine where the drive force is obtained from the reciprocating movement of a piston, it has been a custom to convert the reciprocating motion into the rotating motion by connecting the piston to a crank (or crank pin) of a crankshaft via a connecting rod. Therefore, the piston position in the cylinder is determined by the crank rotating angle (hereinafter referred to as crank angle). Each stroke (or piston position) in the cylinder from the intake stroke to the discharge stroke based on the piston position can be identified by detecting the crank angle.

Japanese Unexamined Patent Publication No. 5-288112 describes an apparatus provided with an engine speed sensor arranged in the vicinity of the crankshaft and a sensor arranged in the vicinity of a camshaft to identify a particular cylinder. A timing rotor, which is a part of the engine rotating sensor, has a plurality of equally spaced teeth. However, a tooth is missing at one location, which produces a gap.

In this apparatus, the engine speed sensor issues a signal each time the gap passes by an electromagnetic pickup. The signal is used as a reference position signal. A controller counts the number of pulses received from the speed sensor after the reference position signal output is received. When the number of counts counted by the counter reaches a predetermined value, the controller calculates the crank angle of a particular cylinder based on the signal from a cylinder identifying sensor.

Since the crankshaft makes two rotations (720° CA) per cycle, it can not be determined whether the crank angle lies between 0° CA and 360° CA or between 360° CA and 720° CA (0° CA and 360° CA during the second rotation) if the judgment is done only based on the signals from the crankshaft (or crank). Therefore, in order to identify a particular cylinder, an identifying signal issued in correspondence with the camshaft, which makes one rotation (720° CA) per cycle, is used to determine whether the crank angle lies between 0° CA and 360° CA or between 360° CA and 720° CA (0° CA and 360° CA of the second rotation).

Thus, it is possible to determine the crank angle for any cylinder of a multi-cylinder engine and specify a cylinder to be ignited or fuel-injected with the help of the engine speed sensor and the cylinder identifying sensor. Moreover, since the cylinder identification signal is issued close to the time that the reference position signal is output, it is possible to determine the cylinder from the beginning of cranking to the reference position signal even if the crank angle is not memorized when the engine is stopped.

However, in the above-mentioned apparatus, the engine speed sensor is arranged in the vicinity of the crankshaft and the cylinder identifying sensor is arranged in the vicinity of the camshaft. Thus, it is necessary to provide two independent sensors to detect the crank angle. This adds complexity to the maintenance of the system.

The above problem may be solved by providing one sensor in the vicinity of the camshaft that functions as both the engine speed sensor and as the cylinder identifying sensor. However, since the camshaft is driven by the crankshaft by means of a timing chain, a timing belt, or other parts, it is impossible to detect timing accurately with such a method due to vibrations of the timing belt or other factors.

In addition, since various data for detecting the crank angle are not memorized when the engine is stopped, cranking is required until the cylinder identifying signal is issued when restarting the engine.

SUMMARY OF THE INVENTION

Accordingly, it is an objective of the present invention to provide an apparatus for detecting the crank angle without two or more independent pass detectors.

Another objective of the present invention is to provide a crank angle detection apparatus for internal combustion engines that is capable of detecting the crank angle immediately after starting the engine.

In order to achieve the above-mentioned objectives, the present invention provides a crankshaft capable of rotating in forward and rearward directions, a plurality of detectable members formed on the entire peripheral surface of the crankshaft in the circumferential direction with an equal interval between one another to rotate integrally with the crankshaft, some of the plurality of detectable members passing by a predetermined zone during rotation, a means for detecting the passage of the detectable members arranged in the vicinity of a rotating path of the detectable members, the detecting means generating at least two signals as the detectable members pass by, a means for determining the rotating direction of the crankshaft by combining the at least two signals generated by the detecting means, a counting means for selectively adding or subtracting the number of detectable members detected by the detecting means based on the rotating direction of the crankshaft determined by the determining means, and a means for controlling the engine based on the detection count of the counting means.

Other aspects and advantages of the present invention will become apparent from the following description, taken in conjunction with the accompanying drawings, illustrating by way of example the principles of the invention.

DETAILED DESCRIPTION OF THE PREFERRED EMBODIMENTS

The structure of a crank angle detection apparatus CD1 for an internal combustion engine that is employed in a first embodiment according to the present invention will now be described with reference to FIG. 1 through FIG. 5.

Figure 1:
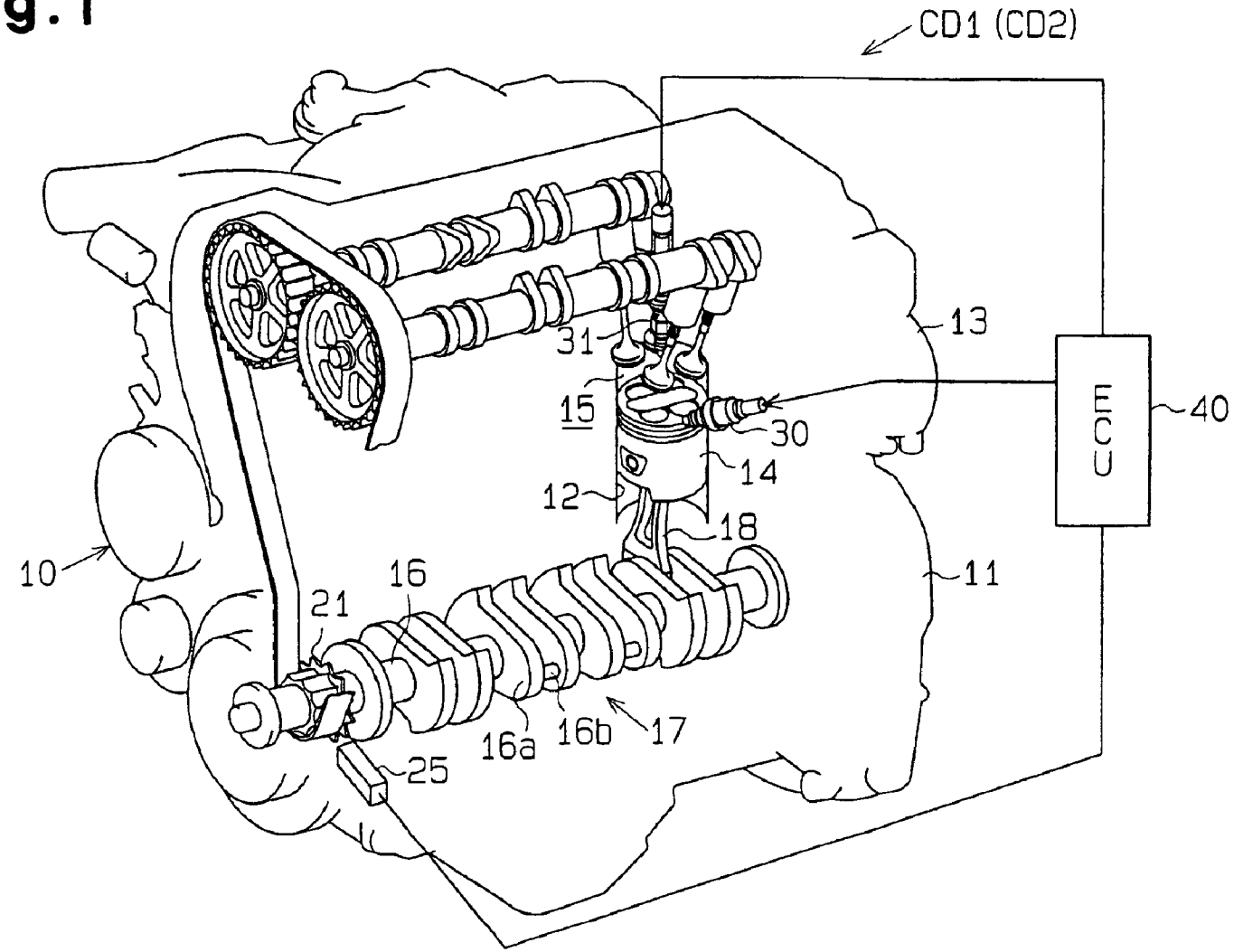
FIG. 1 is a diagrammatic drawing showing the structure of a gasoline engine to which the present invention is applied.
Figure 2:
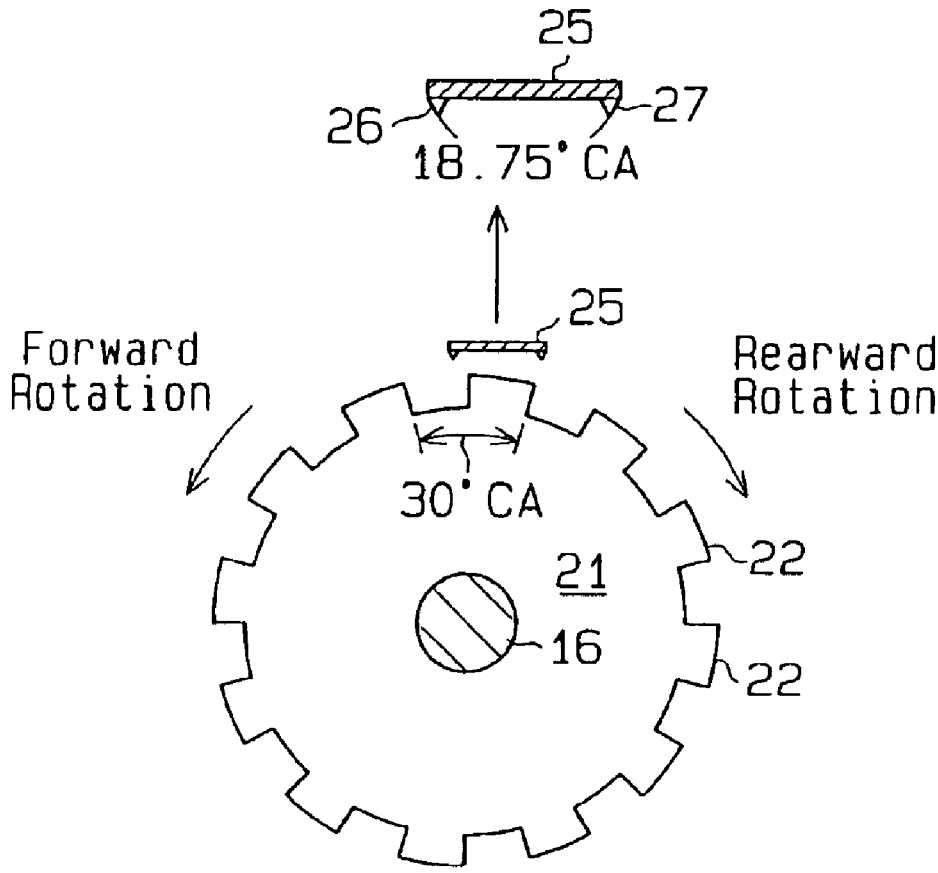
FIG. 2 is an explanatory drawing schematically showing a crank position sensor employed in a first embodiment according to the present invention.

As shown in FIG. 1, an engine 10 has four cylinders 12, which are defined in a cylinder block 11, a piston 12, which reciprocates vertically in each cylinder 12, a combustion chamber 15 defined in each cylinder 12 between a cylinder head 13 and the top surface of the associated piston 14, and a crankshaft 16, which converts the reciprocating motion of the pistons 14 to a rotating motion.

The crankshaft 16 includes cranks 17 located at positions eccentric to the rotating axis. Each crank 17 has a crank arm 16*a* and a crank pin 16*b*. The positions of the cranks 17 are determined in relation with the associated cylinder 12. The position of the crank 17 of each cylinder 12 (the location of the pistons 14 in the associated cylinder 12) is indicated by a crank angle.

Each piston 14 is connected to the crankshaft 16 by means of the associated crank pin 16*b* and a connecting rod 18. Each piston 14 reciprocates vertically and rotates the associated crank 17 about the rotating axis. This rotates the crankshaft 16. The engine 10 is assembled so that cylinder #1 is the compression top dead center.

A crank rotor 21 consisting of a magnetic body is fixed to the crankshaft 16. Twelve teeth 22 are formed on the periphery of the crank rotor 21 with equal angular intervals between one another, e.g., 30° CA. A semiconductor magnetic sensor 25 is provided on the cylinder block 11 in the vicinity of the crankshaft 16 facing the crank rotor 21 to detect the passing of the teeth 22.

The magnetic sensor 25 has a first detection portion 26 and a second detection portion 27, which are separated from each other by a distance narrower than the pitch between the teeth 22 of the crank rotor 21 (e.g., ⅝ of the pitch of the teeth 22) but wider than the width of the teeth 22 (e.g., larger than 15° CA). When the first detection portion 26 detects the passing of a tooth 22, a first pulse signal having a high level is output, and when the tooth 22 moves away from the position facing the first detection portion 26, a first pulse signal having a low level is output. When the second detection portion 27 detects the passing of a tooth 22, a second pulse signal having a high level is output, and when the tooth 22 moves away from the position facing the second detection portion 27, a second pulse signal having a low level is output.

Since the first detection portion and the second detection portion are separated, there is a time difference between the time when a tooth 22 passes by the first detection portion 26 and the time when the same tooth passes by the second detection portion 27. Therefore, the magnetic sensor 25 functions as a differential motion sensor. The sensor 25, which is an independent sensor, enables the judgment of the rotational direction of the crankshaft 16 based on the phase difference between the first pulse signal and the second pulse.

The crank rotor 21 and the magnetic sensor 25 constitute a crank position sensor 20. The magnetic sensor 25 has semiconductor devices such as Hall devices or magnetic resistance devices provided in the detection portions 26, 27.

The cylinder head 13 has an injector 30 and a spark plug 31 for each cylinder 12. The injector 30 supplies fuel to the associated combustion chamber 15 at a certain crank angle and the spark plug 31 ignites the air-fuel mixture in the combustion chamber at a certain crank angle.

Figure 3:
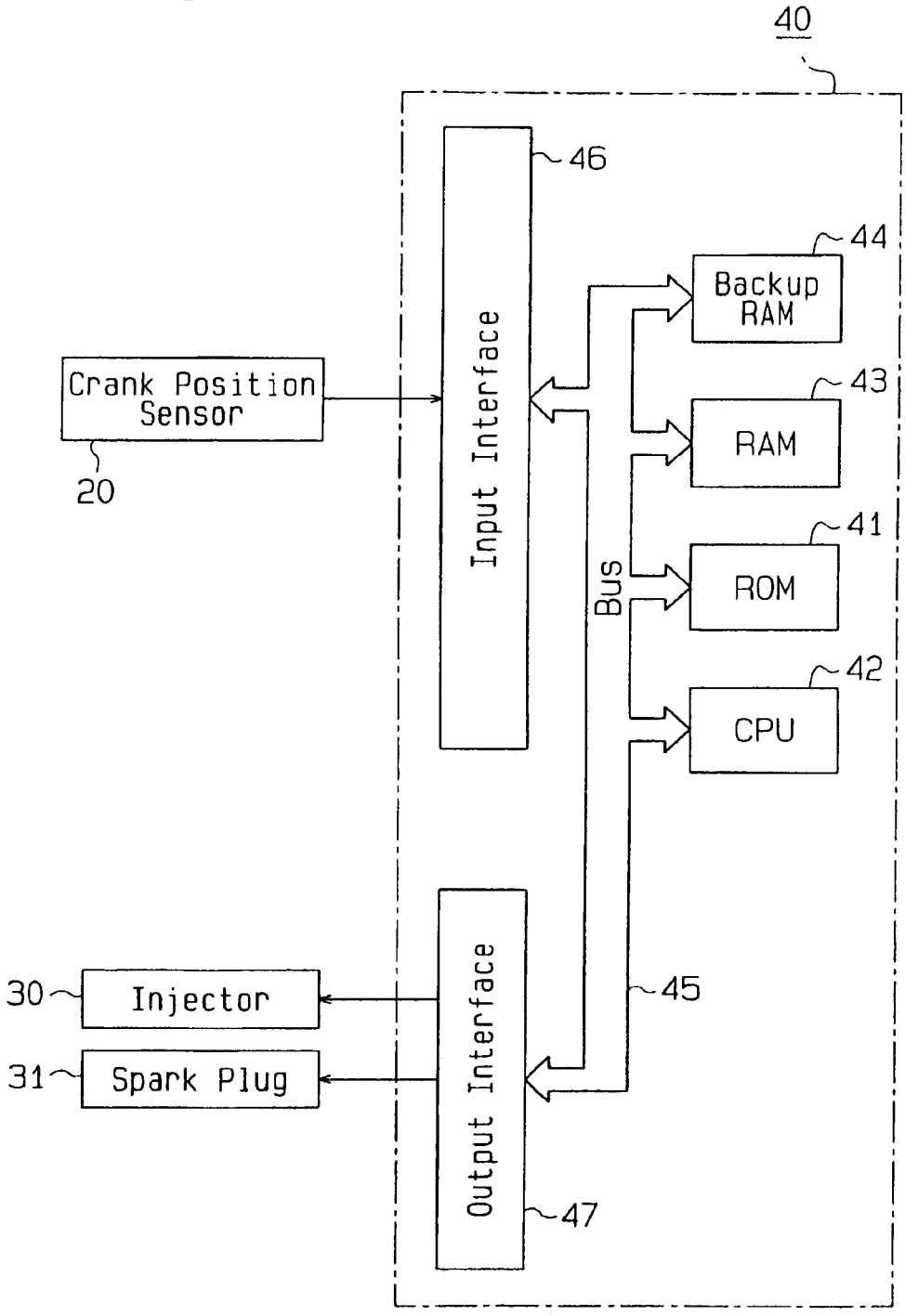
FIG. 3 is a block diagram showing the electric structure of a crank angle detection apparatus of an internal combustion engine.

The electric structure of a crank angle detection device CD1 will now be described with reference to FIG. 3.

Electric power continues to be supplied to an electronic control unit 40 (hereafter referred to as an ECU) for a predetermined period after the engine 10 stops. The ECU 40 has a ROM 41 that stores a crank angle detection process program executed to detect the crank angle of a certain cylinder based on the output signals (first pulse signal and second pulse signal) from the crank position sensor 20, and an ignition timing control program that controls the ignition timing according to the detected crank angle. The ECU 40 includes a CPU 42, which executes computations based on various programs stored in the ROM 41, a RAM 43 for temporarily storing the results of the computation carried out in the CPU 42 and the data sent from each sensor, and a backup RAM 44 for storing various data when the power supply stops after the engine 10 stops such as the counter value C, the flag value F, and the crank counter value CCR, which are stored in the RAM 43.

The CPU 42, the ROM 41, the RAM 43, and the backup RAM 44 are connected to each other via a bidirectional bus 45 and are also connected to an input interface 46 and an output interface 47. The interface 46 is connected with the crank position sensor 20 among other parts. If the signal output from each sensor is an analog signal, it is converted to a digital signal by an A/D converter (not shown) and sent to the bidirectional bus 45. The injector 30, spark plug 31 and the like, which are connected to the output interface 47, are driven based on the computation results of the control program performed by the CPU 42.

Figure 4:
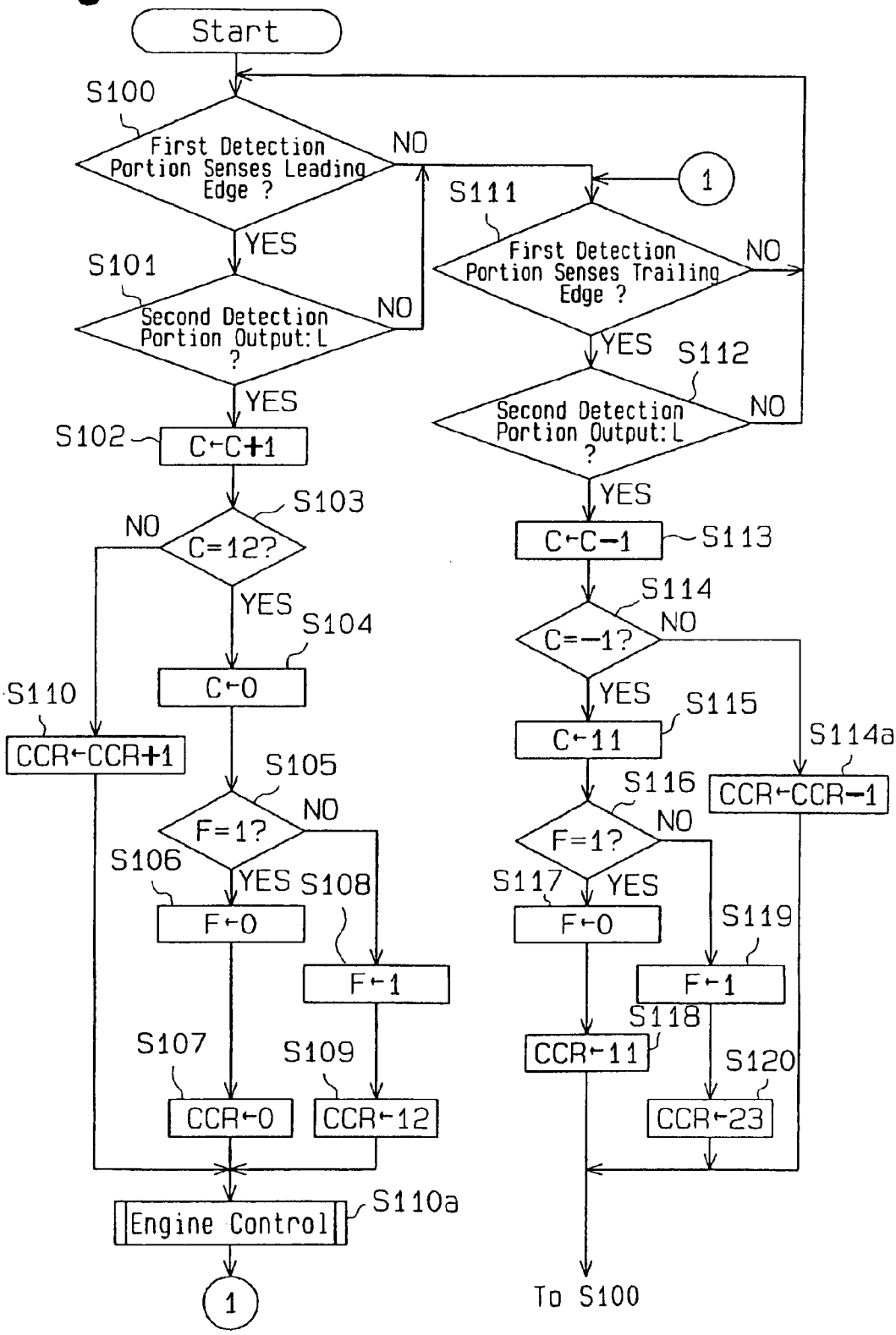
FIG. 4 is a flowchart showing a program for detecting the crank angle in the first embodiment according to the present invention.

The control program executed by the CPU 42 will now be described with reference to the flowchart shown in FIG. 4 and the timing chart shown in FIG. 5.

The engine 10 is assembled in such a way that the cylinder #1 is at the compression top dead center. That is, the initial counter value C, the flag value F, and the initial crank counter value CCR are all zero when the engine 10 is started for the first time after it is assembled.

At step 100, the CPU 42 judges whether or not the first detection portion 28 has detected the leading edge of a tooth 22, or whether or not the output value of the first pulse signal has switched from the low level to the high level. If the output of the first pulse signal has not been switched from the low level to the high level, the CPU 42 proceeds to step 111.

If the output value of the first pulse signal has switched from the low level to the high level at step 100, the CPU 42 proceeds to step 101 to judge whether or not the second pulse signal output is at the low level to determine if the crankshaft 16 is rotating in a forward or rearward direction. The output value of the first pulse signal switches from the low level to the high level when the first detection portion 26 detects the left leading edge of the tooth 22 (crankshaft 16 rotating forward) or when the first detection portion 26 detects the right leading edge (crankshaft 16 rotating rearward). Thus, it is necessary to judge which of the two edges of the tooth 22 the first detection portion 26 has detected.

Figure 5:
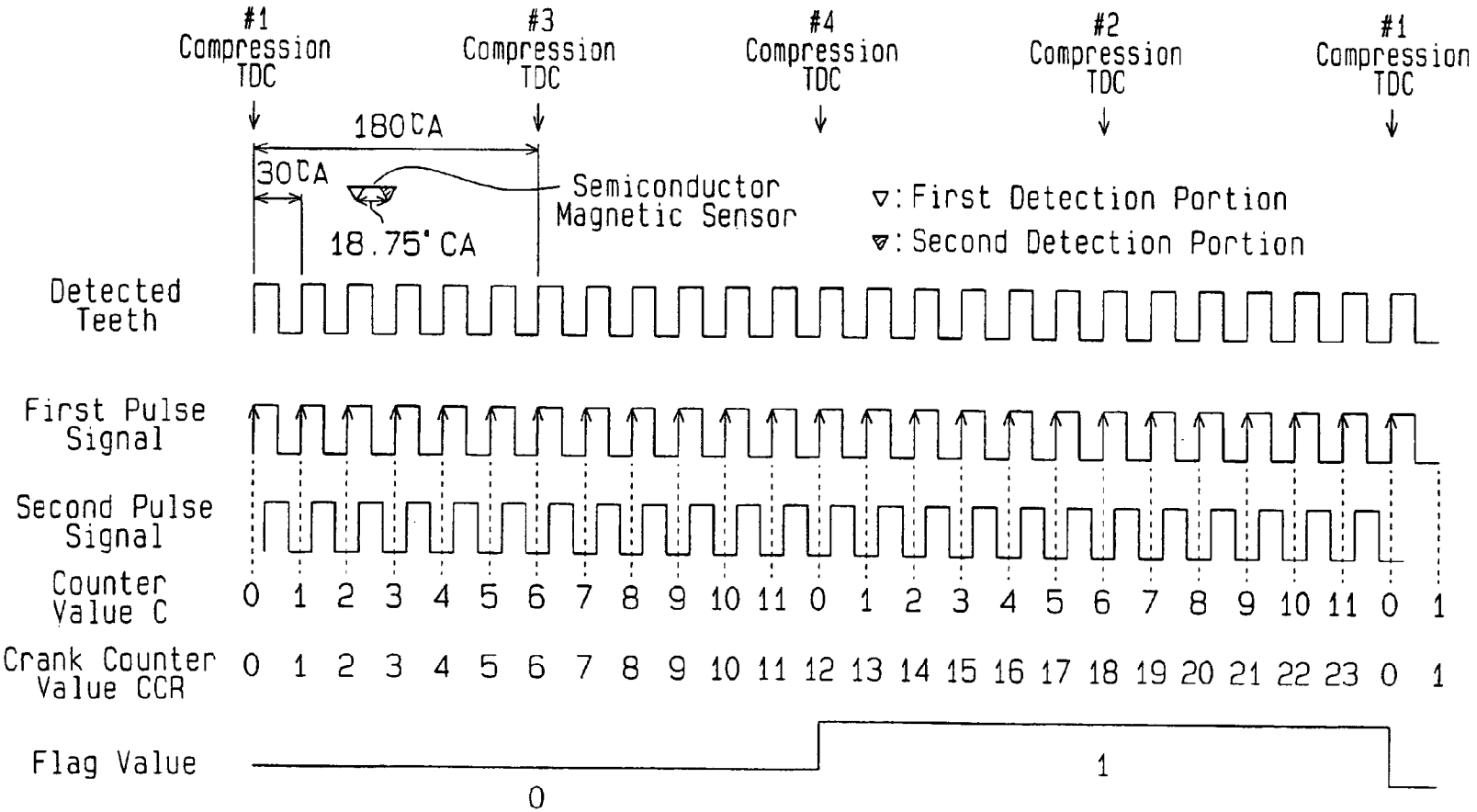
FIG. 5 is a timing chart showing the relationship between the teeth and the semiconductor magnetic sensor as it corresponds to the flowchart shown in FIG. 4, indicating the chronological change of the first pulse signal, the second pulse signal, the sensor value S, the counter value C, and the flag value F.

If the output value of the second pulse signal is at the low level, the pulse signal from the magnetic sensor 25 switches from having a low level first pulse signal and a low level second pulse signal to a high level first pulse signal and a low level second pulse signal, as shown in FIG. 5. Based on the changes of the signal, the CPU 42 judges that the crankshaft 16 is rotating forward. This pattern of the pulse signal occurs only when the left edge of a tooth 22 passes the detection range of the first detection portion 26 as a leading edge.

If the second pulse signal output is at the high level, the pulse signal from the magnetic sensor 25 switches from having a low level first pulse signal and a high level second pulse signal to a high level first pulse signal and a high level second pulse signal. Therefore, the CPU 42 judges that the crankshaft 16 is rotating rearward and proceeds to step 111.

When the crankshaft 16 is rotating forward, the CPU 42 increases the counter value C in an incremental manner in step 102 and then proceeds to step 103. At step 103, the CPU 42 judges whether or not the counter value C has reached the total number of the teeth 22, which is twelve. If the counter value C indicates twelve, the CPU 42 resets the counter value C at step 104. In other words, when the crankshaft 16 completes one revolution, the CPU 42 resets the counter value C. If the counter value C does not indicate twelve in step 103, the CPU 42 increases the crank counter value CCR in an incremental manner at step 110 and then proceeds to step 110*a*.

The CPU 42 then judges whether or not the flag value F is set at one in step 105. If the flag value F is set at one, the CPU 42 proceeds to step 106 and resets the flag value F to 0. The CPU 42 then proceeds to step 106 and resets the crank counter value CCR. At step 110*a*, the CPU 42 executes engine control and then proceeds to step 111.

If the flag value F is not set at one in step 105, the CPU 42 proceeds to step 108 and sets the flag value F at one. The CPU 42 then rewrites the crank counter value CCR to twelve at step 109 and proceeds to the step 110*a* afterward. At step 110*a*, the CPU 42 executes engine control such as ignition timing control and fuel injection timing control based on the crank counter value CCR and proceeds to step 111 afterward.

At step 111, the CPU 42 judges whether or not the first detection portion 26 detected the trailing edge of a tooth 22, or whether the output value of the first pulse signal output signal has switched from the high level to the low level. If the CPU 42 judges that the output value of the first pulse signal has not switched from the high level to the low level, the CPU 42 proceeds to step 100.

If it is determined at step 111 that the output value of the first pulse signal has switched from the high level to the low level, the CPU 42 proceeds to step 112 and judges whether or not the second pulse signal is at the low level to determine if the crankshaft 16 is rotating forward or rearward. The output value of the first pulse signal switches from the high level to the low level when the first detection portion 26 detects the left trailing edge of the tooth 22 (when the crankshaft 16 is rotating rearward) or the right trailing edge (when the crankshaft 16 is rotating forward). Thus, it is necessary to identify which of the left and right edges of the tooth 22 passed by the first detection portion 26.

At step 112, if the CPU 42 judges that the output value of the second pulse signal is at a low level, this indicates that the output value of the pulse signal from the magnetic sensor 25 has changed from having a high level first pulse signal and a low level second pulse signal to a low level first pulse signal and a low level second pulse signal. In this case, it is determined that the crankshaft 16 is rotating rearward. This pattern of the pulse signal occurs only when the first detection portion 26 detects a left trailing edge of a tooth 22.

The rearward motion of the crankshaft 16 occurs when the engine 10 stops. This is due to the crankshaft 16 losing its driving force and rocking until the balance weights are balanced or due to the pressure differences between the cylinders 12. Despite the fact that the engine is stopped at this time, electric power is still supplied to the ECU 40 for a predetermined period after the stoppage of the engine 10 enabling this program to be executed without any problem.

If the output value of the second pulse signal is the high level in step 112, this indicates that the output value of the pulse signal from the magnetic sensor 25 has changed from a high level first pulse signal and a high level second pulse signal to a low level first pulse signal and a high level second pulse signal, as shown in FIG. 5. Therefore, the CPU 42 judges that the crankshaft 16 is rotating forward and proceeds to step 100.

At step 113, the CPU 42 decreases the counter value C by a value of one in a decremental manner in accordance with the rearward rotation of the crankshaft 16. At step 114, the CPU 42 judges whether or not the counter value C is minus one. If the counter value C is minus one, at step 115, the CPU 42 stores the value of eleven as the counter value C. In other words, the counter value C is a value between zero and eleven and minus one corresponds to eleven. If the counter value C is not minus one in step 114, the CPU 42 proceeds to step 114*a* and decreases the crank counter value CCR in a decremental manner.

At step 116, the CPU 42 judges whether or not the flag value F is set at one. If the flag value F is set at one, the,CPU 42 proceeds to step 117 and resets the flag value F to zero. At step 118, the CPU 42 sets the crank counter value CCR to eleven. If the flag value F is set at zero in step 116, the CPU 42 proceeds to step 119 and sets the flag value F at one. At step 120, the CPU 42 sets the crank counter value CCR at twenty three. The flag value F is evaluated only when the counter value C is minus one. This is because the transition of the counter value C from eleven to zero sets or resets the flag value F.

The counter value C, the flag value F, and the crank counter value CCR, which are detected in accordance with the flowchart described above, are all stored into the backup RAM at the present values when the engine 10 stops. When the engine is restarted, the detection of the crank angle is instantaneously based on the stored crank counter value CCR.

The above detection device CD1 is provided with the crank position sensor 20 that includes the crank rotor 21, which has the equally-spaced teeth 22, and the magnetic sensor 25, which has the first detection portion 26 and the second detection portion 27 that are spaced by a distance smaller than the pitch of the teeth 22. As a result, unlike the prior art crank angle detection apparatus, two independent sensors are not required to judge whether the crankshaft 16 is rotating forward or rearward. This reduces the number of parts and manufacturing steps involved.

The first detection portion 26 and the second detection portion 27 are spaced apart by a distance that is smaller than the tooth pitch of the teeth 22. Thus, a difference occurs between the timing of a tooth 22 passing by the first detection portion 26 and the timing of the same tooth 22 passing by the second detection portion 27. This results in a phase difference between the first pulse signal and the second pulse signal output from the magnetic sensor. The phase difference varies depending on whether the crankshaft 16 is rotating forward or rearward.

A crank angle detection processing program that judges the crank angle of a particular cylinder 12 from the crank counter value CCR, which is counted up or counted down based on whether the first and second pulse signals indicate forward or reverse rotation of the crankshaft 16, is provided.

The counter value C, the flag value F, and the crank counter value CCR existing at the time of stoppage of the engine 10 are stored while the engine 10 is stopped. Therefore, the crank angle is detected immediately after cranking unlike the prior art crank angle detection apparatus, which detects the reference position each time cranking is carried out and requires time to detect the crank angle.

As a result, the air-fuel mixture can be ignited in a particular cylinder immediately after cranking (starting of engine 10). It is necessary to execute the ignition of the air-fuel mixture at a predetermined crank angle prior to the compression top dead center in order to produce drive force effectively. To achieve this, the cylinder 12 must be distinguished and the crank angle must be detected. However, in the prior art crank angle detection apparatus, a certain length of time was required for detection. Thus, the engine could not be immediately started. To solve this problem, the detection apparatus CD1 is capable of detecting the crank angle of a particular cylinder 12 immediately after cranking.

A crank angle detection apparatus CD2 for internal combustion engines of a second embodiment according to the invention has further benifits in addition to the advantages that are obtained by the crank angle detection apparatus CD1 for internal combustion engines of the first embodiment of the invention.

Figure 6:
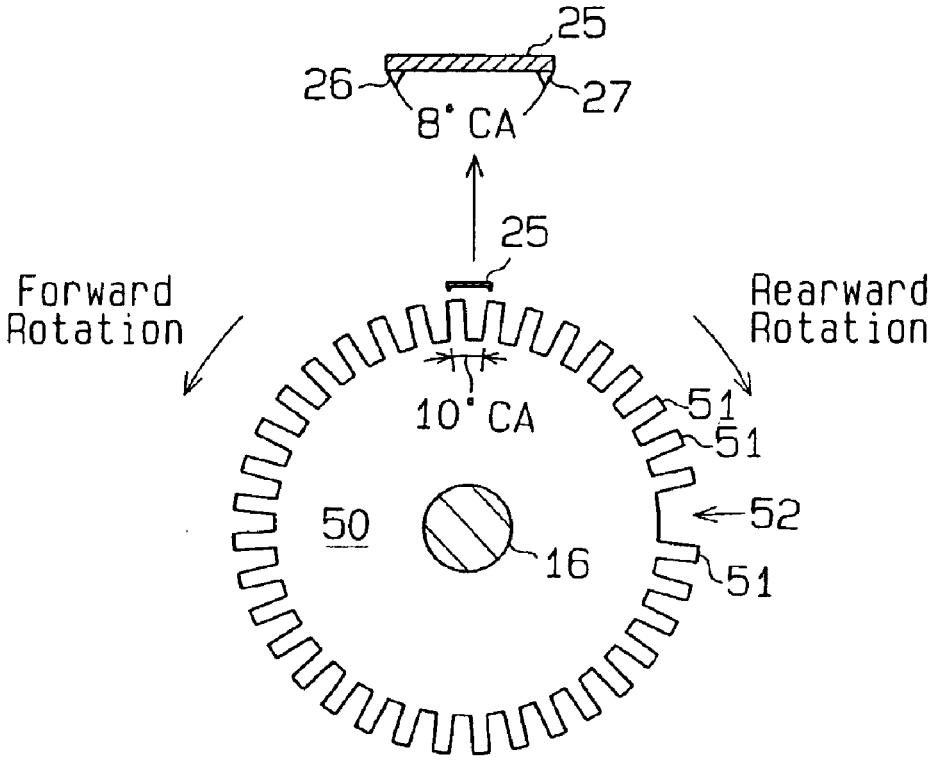
FIG. 6 is an explanatory drawing showing a crank position sensor employed in a second embodiment according to the present invention.

A crank angle detection apparatus CD2 for internal combustion engines of the second embodiment will now be described with reference to FIG. 6.

On the periphery of the crank rotor 50, there are 35 teeth 51 that are formed with a pitch of 10° CA with one tooth 51 missing in a manner defining a gap 52. Thus, the interval between adjacent teeth 51 at the gap 52 is 20° CA.

The magnetic sensor 25 facing the crank rotor 50 in the cylinder block 11 has a first detection portion 26 and a second detection portion 27, which are separated from each other by a pitch of about five to eight ° CA.

Figure 7A:
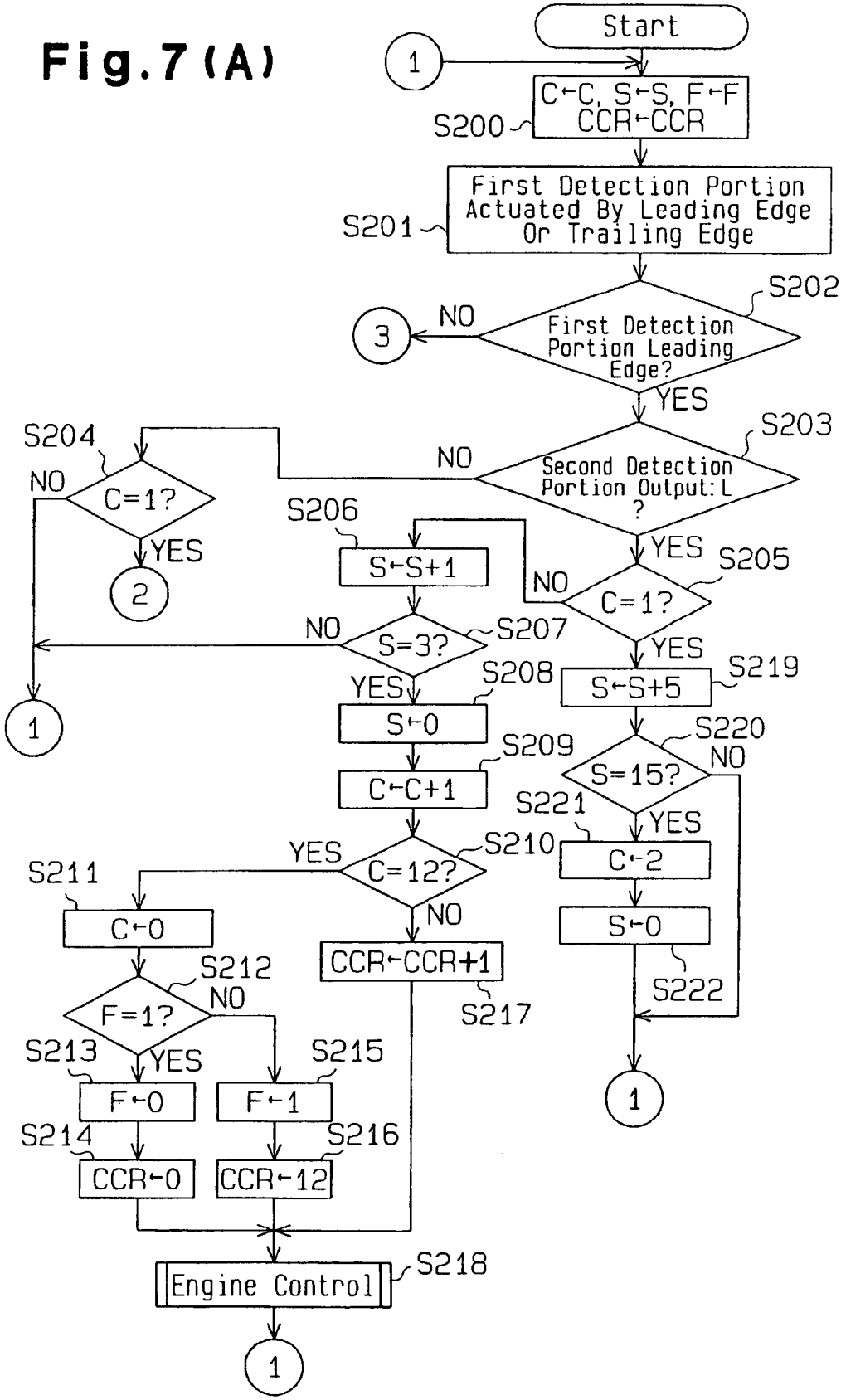
FIG. 7 (A) and FIG. 7 (B) are flowcharts showing a crank angle detection processing program employed in the second embodiment.
Figure 7B:
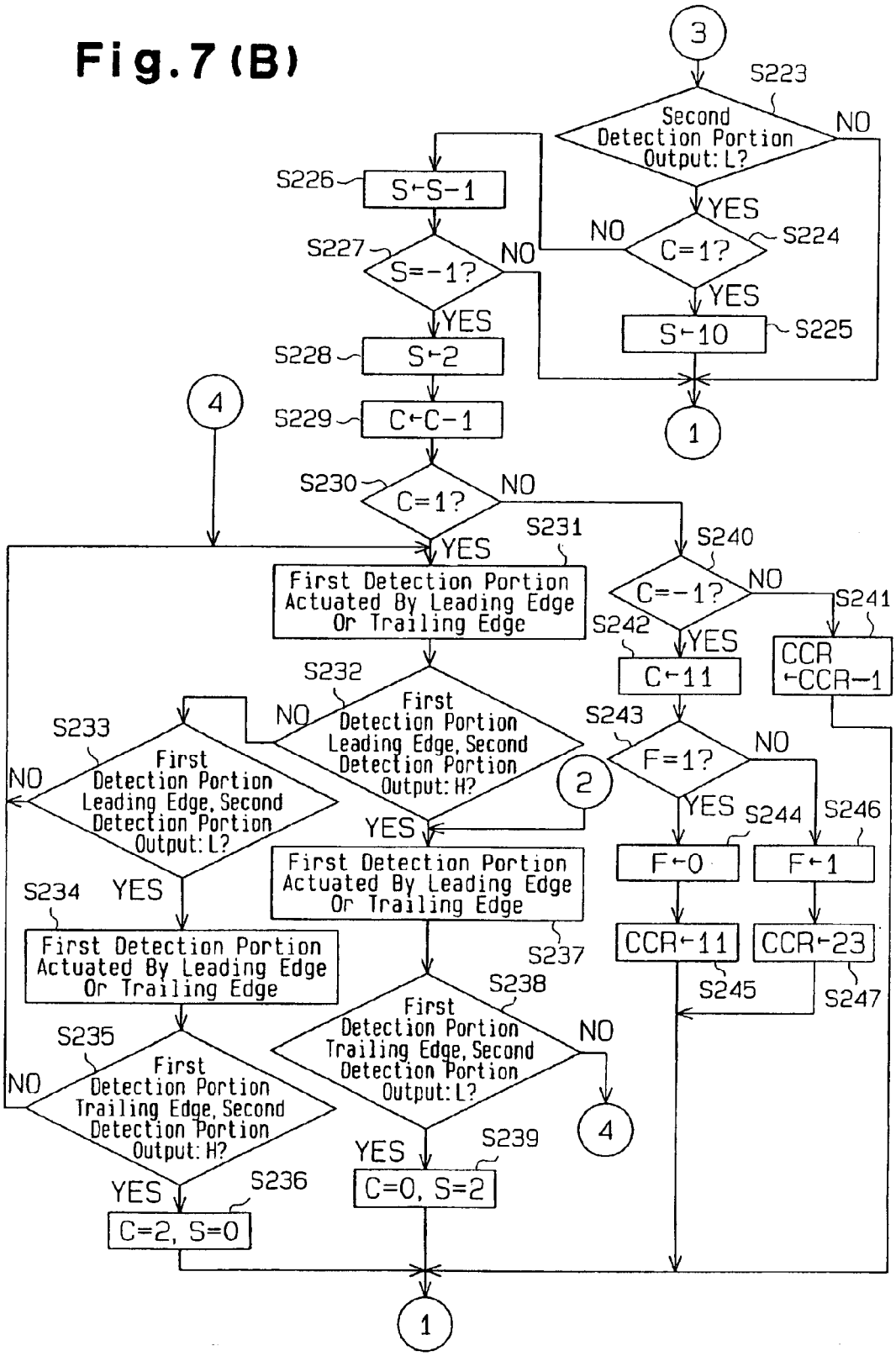

A crank angle detection program employed in the crank angle detection apparatus CD2 for internal combustion engines according to this embodiment will now be described with reference to the flowcharts of the crank angle detection program shown in FIG. 7(A) and FIG. 7(B) and the timing charts shown in FIG. 8 and FIG. 9.

In this embodiment, the engine 10 is assembled so that cylinder #1 is at the compression top dead center. Thus, when the engine 10 is assembled, the initial values of the counter value C, the sensor value S, the flag value F, and the crank counter value CCR are all zero when the engine 10 is started for the first time. The counter value C and the crank counter value CCR are increased in an incremental manner or decreased in a decremental manner each time the angular position of the crankshaft changes by 30 degrees. The sensor value S is increased in an incremental manner or decreased in a decremental manner each time the angular position of the crankshaft changes by 10 degrees.

At step 200, the CPU 42 stores the initial values of the counter value C, the sensor value S, the flag value F and the crank counter value CCR, or each of those values C, S, and F that were obtained in the previous cycle, in the RAM 43. At step 201, the CPU 42 detects either the trailing edge of a tooth 51 (the first pulse signal output value switched from the high level to the low level) as it passes by the first detection portion 26, or the leading edge of a tooth 51 (the first pulse signal output value switched from the low level to the high level).

When the first detection portion 26 detects the rising edge of the tooth 51 and the CPU 42 judges that the first pulse signal output has switched from the low level to the high level in step 202, the CPU 42 proceeds to step 203 and judges whether or not the output value of the second pulse signal output is at the low level to determine if the crankshaft 16 is rotating forward or rearward. The output value of first pulse signal switches from the low level to the high level when the first detection portion 26 detects the left leading edge of the tooth 51 (when the crankshaft 16 is rotating forward) or the right leading edge of the tooth 51 (when the crankshaft 16 is rotating rearward). Therefore, it is necessary to determine which of the left and right edges of the tooth 51 has been detected.

At step 203, if the output value of the second pulse signal is not at the low level, this indicates that the pulse signal sent from the magnetic sensor 25 changed from having a low level first pulse signal and a high level second pulse signal to a high level first pulse signal and a high level second pulse signal. Thus, the CPU 42 judges that the crankshaft 16 is rotating rearward and proceeds to step 204.

The CPU 42 judges whether or not the counter value C is set at one. If the counter value C is not set at one, the CPU 42 returns to the step 200. If the counter value C is set at one, the CPU 42 proceeds to step 237. It is determined whether the counter value C is set at one, since the gap 52 corresponds to the counter value C of one. Detection of the gap 52 by the first detection portion 26 is prohibited, as described below.

Figure 8:
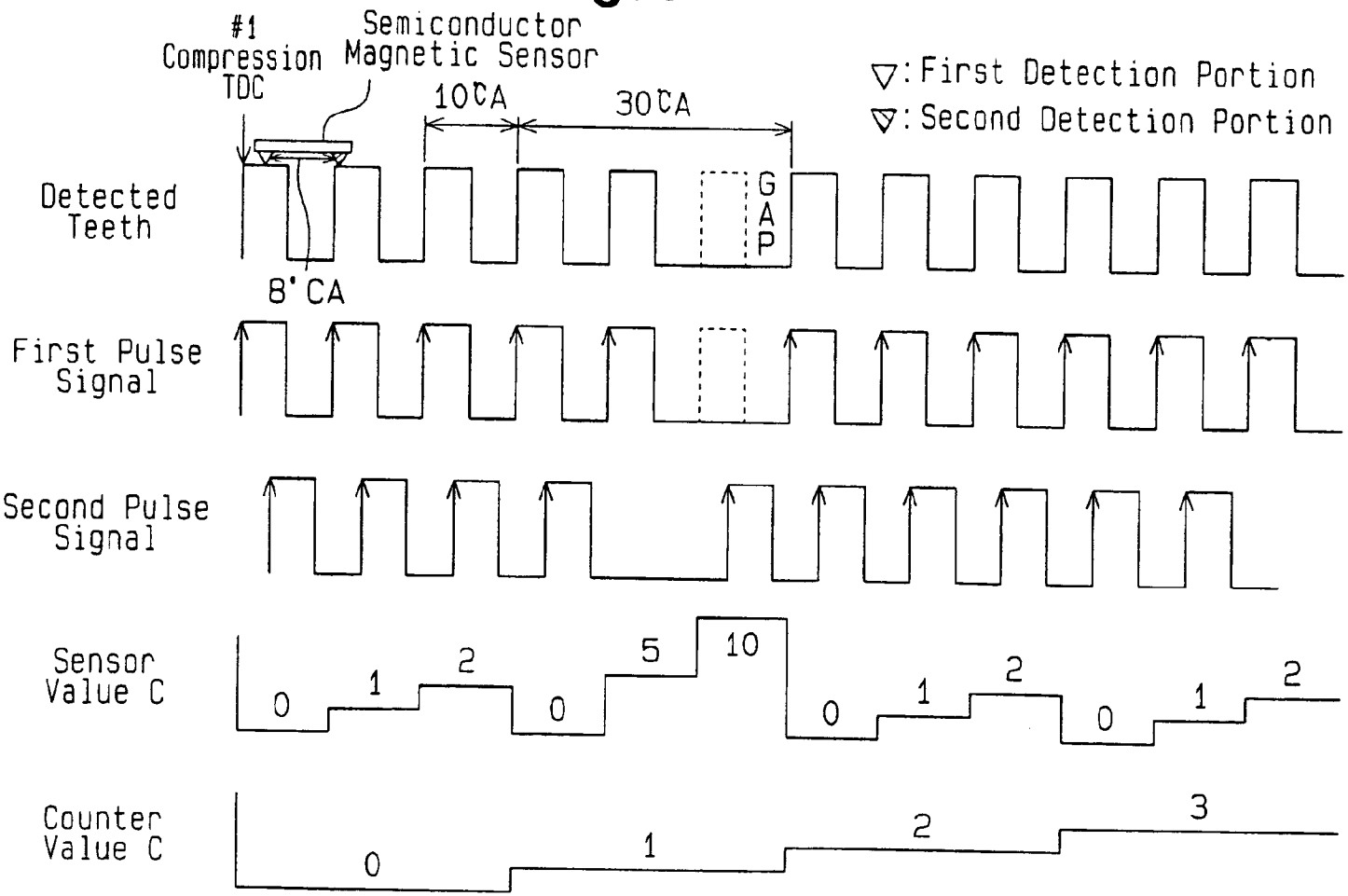
FIG. 8 is a timing chart, which corresponds to the flowchart shown in FIG. 7, showing the relation between the teeth and the gap relative to the semiconductor magnetic sensor as well as the chronological changes of the sensor value S and the counter value C.
Figure 9:
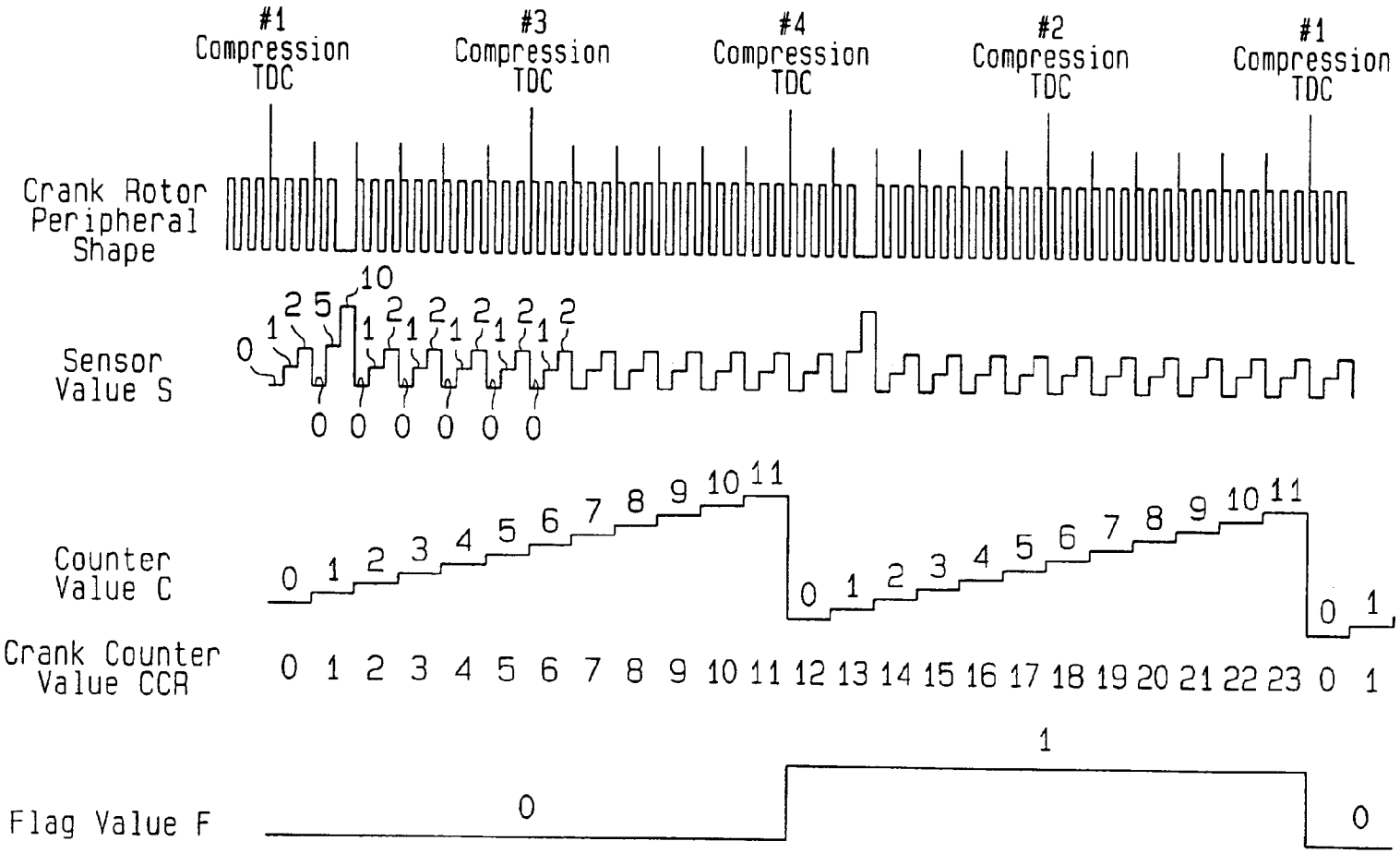
FIG. 9 is a timing chart, which corresponds to the flowchart shown in FIG. 7, showing the relation between the teeth and the gap relative to the semiconductor magnetic sensor as well as the chronological changes of the first pulse signal, the second pulse signal, the sensor value S, the counter value C, the crank counter value CCR, and the flag value F.

In step 203, if the output value of the second pulse signal is at the low level, this indicates that the pulse signal sent from the magnetic sensor 25 changed from having a low level first pulse signal and a low level second pulse signal to a high level first pulse signal and a low level second pulse signal, as shown in FIG. 8. In this case, the CPU 42 judges that the crankshaft 16 is rotating forward and proceeds to step 205. This pattern of the pulse signal occurs only when the first detection portion 26 detects a left leading edge of a tooth 51.

At step 205, the CPU 42 judges whether or not the counter value C is set at one. If the counter value C is not set at one, the CPU 42 proceeds to step 206 and adds one to the sensor value S in an incremental manner. The sensor value S increases in an incremental manner each time the first detection portion 26 detects the left edge of a tooth 51. If the counter value C is a value other than one, the CPU 42 resets the sensor value S at zero when the sensor value S reaches three. If the counter value C is set at one, the sensor value S is reset to zero when the sensor value S reaches fifteen (corresponding to 30° CA if the teeth 51 are formed at equal intervals). The counter value C is increased in an incremental manner every 30° CA. This is carried out to judge whether or not the crank rotor 50 is rotating forward or rearward within a range of 30° CA from the start.

The CPU 42 then proceeds to step 207 and judges whether or not the sensor value S indicates three. If the sensor value S does not indicate three, the CPU 42 returns to step 200. If the sensor value S indicates three, the CPU 42 resets the sensor value S. In this case, the CPU 42 resets the sensor value S and proceeds to step 209 to add one to the counter value C in an incremental manner. Afterwards, the CPU 42 proceeds to step 210.

At step 210, the CPU 42 judges whether or not the counter value C indicates twelve to determine if the crankshaft 16 has undergone a complete rotation. If the counter value C indicates twelve, the CPU 42 proceeds to step 211 and resets the counter value C. At step 212, the CPU 42 judges whether the flag value F is set at one. If the flag value F is set at one, the CPU 42 proceeds to step 213 and resets the flag value F. At step 214, the CPU 42 resets the crank counter value CCR.

When the flag value F is not set at one in step 212, the CPU 42 proceeds to step 215 and sets the flag value F to 10 one. At step 216, the CPU 42 sets the crank counter value CCR to twelve.

If the counter value C does not indicate twelve at step 210, the CPU 42 proceeds to step 217 and increases the crank 15 counter value CCR in an incremental manner. After performing steps 214, 216, and 217, the CPU 42 proceeds to step 218 to execute engine controls such as fuel injection control and ignition control based on the crank counter value CCR and subsequently returns to step 200.

If the counter value C indicates one in step 205, the CPU 42 proceeds to step 219, the CPU 42 adds a value of five to the sensor value S in an incremental manner, which is necessary to prohibit detection by the first detection 25 portion 26 when the counter value C is set at one. This is to avoid erroneous detection when the first detection portion 26 is opposed to the gap 52.

At step 220, the CPU 42 judges whether or not the 30 sensor value S is set at fifteen and proceeds to step 221 if the sensor value S indicates fifteen. As shown in FIG. 9, under the condition of C=1, if the sensor value S indicates fifteen, this indicates that the gap 52 has passed the first detection portion 26 due to the steps described below. At step 221, the CPU 42 sets the counter value C to two. At step 222, the CPU 42 resets the sensor value S and then returns to step 200. If the sensor value S does not indicate fifteen in step 220, the CPU 42 returns to step 200.

At step 202, if it is determined that the first pulse signal output has not switched from the low level to the high level, the CPU 42 proceeds to step 223 and judges whether or not the second pulse signal output is at the low level. This is to determine whether the crankshaft 16 is rotating forward or rearward. It is necessary to determine, which of the two edges of the tooth 51 has passed by the first detection portion 26. This is because the output value of the first pulse signal switches from the high level to the low level when the first detection portion 26 detects either a right trailing edge or a left trailing edge of a tooth 51.

When the output value of the second pulse signal is not at the low level in step 223, this indicates that the pulse signal sent from the magnetic sensor 25 has changed from having a high level first pulse signal and a high level second pulse signal to a low level first pulse signal and a high level second pulse signal, as shown in in FIG. 8. In this case, it is determined that the crankshaft 16 is rotating forward. That is, the change pattern of the pulse signal corresponds to the change pattern that occurs only when the first detection portion 26 detects a right trailing edge of a tooth 51. Therefore, the CPU 42 returns to step 200.

When the output value of the second pulse signal is at the low level in step 223, either the crankshaft 16 is rotating rearward or the magnetic sensor 25 is located at a position corresponding to the gap 52. In order to determine which of these two conditions exists, the CPU 42 proceeds to step 224 and judges whether or not the counter value C is set at one, or whether or not the magnetic sensor 25 is located at a position corresponding to the gap 52. If the CPU 42 judges that the counter C value is set at one in step 224, this indicates that the magnetic sensor 25 is located at a position corresponding to the gap 52. In this case, the sensor value S is set to ten to indicate that the magnetic sensor 25 is located at a position corresponding to the gap 52.

If the counter value C is not set at one (S224: NO), this indicates that the output value of the pulse signal sent from the magnetic sensor 25 has changed from having a high level first pulse signal and a low level second pulse signal to a low level first pulse signal and a low level second pulse signal. Thus, the CPU 42 determines that the crankshaft 16 is rotating rearward and proceeds to step 226.

The CPU 42 then proceeds to step 226 and decreases the sensor value S by a value of one in a decremental manner in accordance with the judgment that the crankshaft 16 is rotating rearward. At step 227, the CPU 42 judges whether or not the decreased sensor value S is set at minus one. If it is determined that the sensor value S is not minus one, the CPU 42 returns to step 200.

When the sensor value S is set at minus one in step 227, the CPU 42 proceeds to step 228 and sets the sensor value S to two. The sensor value S takes the values of zero, one, or two, and minus one corresponds to two.

In the following step 229, the CPU 42 decreases the counter value C by one in a decremental manner. At step 230, the CPU 42 judges whether or not the counter value C is set at one. If the counter value C is not set at one, the CPU 42 proceeds to step 240 and judges whether or not the counter value C is set at minus one. If the counter value C is not set at minus one, the CPU 42 proceeds to step 241 and decreases the crank counter value CCR in a decremental manner and then returns to step 200. If the counter value C is set at minus one in step 240, the CPU 42 proceeds to step 242 and sets the counter value C to eleven. The counter value C takes a value between zero and eleven, and minus one corresponds to eleven.

At step 243, the CPU 42 judges whether or not the flag value F is set at one. If the flag value F is set at one in step 243, the CPU 42 proceeds to step 244 and resets the flag value F. The CPU 42 then proceeds to step 245 and sets the crank counter value CCR to eleven and subsequently returns to step 200.

At step 243, if the flag value F is not set at one, the CPU 42 proceeds to step 246 and sets the flag value F at one. The CPU 42 then proceeds to step 247 and sets the crank counter value CCR to twenty three. The CPU 42 subsequently returns to step 200.

If the counter value C is set at one in step 230, this indicates that the magnetic sensor 25 is facing the gap 52.

Thus, the CPU 42 proceeds to step 231 to perform special processing to eliminate erroneous detections. At step 231, the CPU 42 detects the trailing edge or the leading edge of the tooth 51 with the first detection portion 26. At step 232, the CPU 42 judges whether or not the output value of the first pulse signal has switched from the low level to the high level and whether or not the output value of the second pulse signal is at the high level. If the first pulse signal is rising and the second output value of the pulse signal is not at the high level, the CPU 42 proceeds to step 233 and judges whether or not the first pulse signal is rising and the output value of the second pulse signal is at the low level.

When the CPU 42 judges that the first pulse signal is rising and the output value of the second pulse signal is not at the low level in step 233, it determines that the second detection portion 27 is located at a position corresponding to the gap 52 and proceeds to step 231. When the first pulse signal rises and the output value of the second pulse signal is at the low level in step 233, the CPU 42 once again detects the trailing edge or leading edge of a tooth 51.

At step 235, it is judged whether or not the output value of the first pulse signal has changed from the high level to the low level and whether or not output value of the second pulse signal is at the high level. If the output value of the first pulse signal has switched from the high level to the low level and the output value of the second pulse signal is at the high level, the CPU 42 proceeds to step 236 and sets the counter value C to two and the sensor value S to zero. The CPU 42 then returns to step 200. In other words, this signal pattern under the condition that the counter value C is one indicates that the crankshaft 16 is rotated forward due to rocking and also indicates that the gap 52 has passed by the magnetic sensor 25, as shown in FIG. 9.

In step 235, if the output level of the first pulse signal has switched from the high level to the low level and the output value of the second pulse signal is not at the high level, this indicates that the second detection portion 27 is detecting the gap 52. Thus, the CPU 42 proceeds to step 231. On the other hand, if the first pulse signal is rising and the output value of the second pulse signal is at the high level in step 232, the CPU 42 once again detects the leading edge or the trailing edge of a tooth 51 with the first detection portion 26 in the following step 237.

At step 238, the CPU 42 judges whether the output value of the first pulse signal has switched from the high level to the low level and whether the output value of the second pulse signal is at the low level. When the output value of the first pulse signal switches from the high level to the low level and the output value of the second pulse level is not at the low level, this indicates that the second detection portion 27 is located at a position corresponding to the gap 52. In this case, the CPU 42 proceeds to step 231.

At step 238, if the output value of the first pulse signal has switched from the high level to the low level and the output value of the second pulse signal is at the low level, the CPU 42 sets the counter value C to zero and the sensor value S to two. The CPU 42 then returns to step 200. This signal pattern, when the counter value C is set at one, indicates that the crankshaft 16 is rotating rearward and the magnetic sensor 25 has finished detecting the gap 52.

When the engine 10 stops, the above-mentioned counter value C, the sensor value S, the flag value F, and the crank counter value CCR (crank angle) are all stored in the backup RAM 44 at their current values. Therefore, it is possible to detect the crank angle instantaneously based on the crank counter value CCR when the engine restarts. This improves the starting performance of the engine 10.

The detection apparatus CD2 of the second embodiment includes the crank position sensor 20 provided with the crank rotor 50, which has the gap 52 defined by a missing tooth 51, and the magnetic sensor 25, which is provided with the first detection portion 26 and the second detection portion 27.

Accordingly, if the counter value C, flag value F, and crank counter value CCR are all lost when the battery is removed during maintenance, the magnetic sensor 25 detects the gap 52 and resets the counter value C corresponding to the crank angle. This returns the relationship between the crank counter value CCR and the crank angle to the original state.

Although the crank angle detection apparatus is applied to the engine 10 having four cylinders 12 in the above embodiments, the apparatus may be applied to other types of engines such as six or eight cylinder engines.

What is claimed is:

1. An apparatus for determining the crank angle of an engine crankshaft, wherein the crankshaft rotates in a first direction and in a second direction, wherein the second direction is opposite to the first direction, the apparatus comprising:

indications located at predetermined angular intervals on the crankshaft, wherein each indication rotates integrally with the crankshaft along a path and passes near a detecting zone during crankshaft rotation;

a detector device for detecting the passage of the indications, the detector device being located in the vicinity of the path, wherein the detector generates at least two signals, the statuses of which vary between a first state and a second state as the indications pass by;

direction determining means for determining the statuses of the signals and for determining the rotation direction of the crankshaft on the basis of the statuses of the signals; and a control means for keeping a count based on the number of indications detected by the detector device and for controlling the engine based on the count.

2. The apparatus according to claim 1 further comprising a counter for incrementing the count when the direction determining means determines that the crankshaft is rotating in the first direction and for decrementing the count when the direction determining means determines that the crankshaft is rotating in the second direction based on the number of indications detected by the detector device.

3. The apparatus according to claim 2 further comprising a rotor fixed to the crankshaft, wherein the indications are teeth formed on the rotor.

4. The apparatus according to claim 2 further comprising: computing means for estimating the angle of the crankshaft based on the number of indications detected by the detector device; and means for resetting the count after a full rotation of the crankshaft.

5. The apparatus of claim 2, wherein nearly all adjacent indications are equally spaced apart from one another by a first predetermined distance, and the detecting device includes a first detector and a second detector, wherein the first and second detectors are spaced apart by a distance that is less than the first predetermined distance, and wherein the indications are arranged to include a gap that is wider than the first predetermined distance.

6. The apparatus according to claim 2 further comprising an electric control unit that serves as the direction determining means and the counter, wherein the electrical control unit is supplied with power for a predetermined time period after the engine is shut off.

7. The apparatus according to claim 1, wherein adjacent indications are equally spaced apart from one another by a first predetermined distance, and the detecting device includes a first detector and a second detector, wherein the first and second detectors are spaced apart by a distance that is less than the first predetermined distance.

8. An apparatus for determining the crank angle of an engine crankshaft, wherein the crankshaft rotates in a first direction and in a second direction, wherein the second direction is opposite to the first direction, the apparatus comprising:

a set of indications located at predetermined angular intervals on the crankshaft, wherein each indication rotates integrally with the crankshaft along a path and passes near a detecting zone during crankshaft rotation;

a marking means for marking one location on the crankshaft;

a detector device for detecting the passage of the indications, the detector device being located in the vicinity of the path, wherein the detector generates at least two signals, the statuses of which vary between a first state and a second state as the indications pass by;

direction determining means for determining the rotation direction of the crankshaft based on the statuses of the signals;

a counter for keeping a count based on the number of indications detected by the detector device, wherein the counter increments the count when the direction determining means determines that the crankshaft is rotating in the first direction and for decrements the count when the direction determining means determines that the crankshaft is rotating in the second direction;

a reset means for detecting the passage of the marked location, wherein the reset means resets the count to a predetermined value when the marked location is detected; and a control means for controlling the engine based on the count.

9. The apparatus according to claim 8, wherein nearly all adjacent indications are spaced apart from one another by a first predetermined distance, and the detecting device includes a first detector and a second detector, wherein the first and second detectors are spaced apart by a distance that is less than the first predetermined distance.

10. The apparatus according to claim 8 further comprising:

a rotor fixed to the crankshaft; and a plurality of teeth formed on the rotor, wherein the teeth are the indications, and wherein the teeth are arranged to include a gap that is wider than the first predetermined distance, and wherein the gap serves as the marking means.

11. The apparatus according to claim 8 further comprising: computing means for estimating the angle of the crankshaft based on the number of indications detected by the detector device; and means for resetting the count after a full rotation of the crankshaft.

12. A method of detecting the crank angle of an engine crankshaft, wherein the crankshaft rotates in a first direction and in a second direction, wherein the second direction is opposite to the first direction, the method comprising:

locating a plurality of indications at predetermined angular intervals on the crankshaft, wherein each indication rotates integrally with the crankshaft along a path and passes near a detecting zone during crankshaft rotation;

detecting the passage of the indications with a plurality of detectors, each detector being positioned at a different location;

generating a signal with each detector as the indications pass by the detectors, wherein the signals differ from one another in phase, and wherein each signal varies between a first state and a second state according to the proximity of an indication;

determining the rotation direction of the crankshaft on the basis of the statuses of at least a pair of the signals;

keeping a count of the number of indications detected by the detector device; and a control means for controlling the engine based on the count.

13. The method of claim 12 further comprising:

detecting an edge of one of the indications by detecting a change in the status of a first one of the signals; upon detecting an edge of an indication, determining the status of a second one of the signals; and based on the statuses of the first and second signals, performing the step of determining the direction of rotation of the crankshaft.

14. A method of claim 12 further comprising:

detecting a marked angular position of the crankshaft by comparing the statuses of the signals; and setting the count to a predetermined value when the marked angular position is detected.

15. The method of claim 14 further comprising the step of storing the current count value when the engine is shut off; and retrieving the stored count value as the current count value when the engine is restarted.

16. The method of claim 12 further comprising the steps of: incrementing the count when it is determined that the crankshaft is rotating in the first direction; and decrementing the count when it is determined that the crankshaft is rotating in the second direction.

* * * * *